US005103589A

United States Patent [19]

Crawford

[11] Patent Number: 5,103,589

[45] Date of Patent: Apr. 14, 1992

[54] SLIDING PANEL SECURITY ASSEMBLY AND METHOD

[76] Inventor: Ralph E. Crawford, 3301 SW. 13th Dr., Deerfield Beach, Fla. 33442-8108

[21] Appl. No.: 689,355

[22] Filed: Apr. 22, 1991

[51] Int. Cl.[5] ..... E05D 15/26

[52] U.S. Cl. ..... 49/125; 49/404; 52/207

[58] Field of Search ..... 49/404, 125; 52/207; 160/90, 91

[56] References Cited

U.S. PATENT DOCUMENTS

| | | | |
|---|---|---|---|
| D. 216,955 | 3/1970 | Dallaire | D13/6 |
| D. 226,374 | 2/1973 | Dallaire . | |
| D. 250,352 | 11/1978 | Dallaire | D25/74 |
| D. 250,843 | 1/1979 | Mauro | D25/74 |
| 1,852,608 | 4/1932 | Grable | 49/125 X |
| 2,196,591 | 4/1940 | Kramer | 49/125 X |
| 3,100,916 | 8/1963 | McKinney | 49/125 |
| 3,167,112 | 1/1965 | Tucker | 160/90 X |
| 3,295,587 | 1/1967 | Horgan, Jr. | 160/91 |
| 3,324,597 | 6/1967 | Rich | 160/90 X |
| 3,529,382 | 9/1970 | Salvarola | 49/125 X |
| 3,693,293 | 9/1972 | Egan, Jr. et al. | 49/125 X |
| 3,802,127 | 4/1974 | Silvernail | 52/207 X |
| 3,984,954 | 10/1976 | Takeda | 49/404 X |
| 4,248,461 | 2/1981 | Stevens | 292/218 |
| 4,284,299 | 8/1981 | Kelly | 292/87 |
| 4,379,576 | 4/1983 | Blough et al. | 292/205 |
| 4,526,412 | 7/1985 | Gist | 292/258 |
| 4,643,005 | 2/1987 | Logas | 70/95 |
| 4,763,933 | 8/1988 | Guardia | 292/13 |

*Primary Examiner*—Philip C. Kannan
*Attorney, Agent, or Firm*—Oltman and Flynn

[57] ABSTRACT

An apparatus for securing telescoping sliding panels, which are essentially oriented in parallel, vertical planes, against movement perpendicular to their sliding directions, includes a track, parallel first and second carriages which retain the lower edge of each panel and ride along the track, a lip projecting from the first carriage having an upturned free end, a lip projecting from the second carriage, having a downturned free end which extends between the first carriage and the upturned end of its lip. The carriage for each panel preferably includes a body portion which is tubular and has wheels mounted beneath it and gripping members projecting from the top of it for holding a vinyl channel which receives the lower edge of the panel. The track has an upper surface with channels recessed into it for guiding the carriages. An edge of the track is turned upward at a right angle to form a wall for retaining the carriages. The wall is provided with a lip described above. A threshold member is optionally provided which attaches to the wall and a channel of the track, to provide a horizontal surface which a person can step on without damaging it. The threshold member may have a lip described above. A method for retaining the panels includes the step of placing the downward portion of the second lip between the upward portion of the first lip and the first carriage.

15 Claims, 5 Drawing Sheets

SLIDING PANEL SECURITY ASSEMBLY AND METHOD

BACKGROUND OF THE INVENTION

1. Field of the Invention

The present invention relates generally to the field of telescoping sliding panels, and more specifically to a panel track and panel carriages with interlocking lips which prevent the panels from being pushed or lifted out of the track.

2. Description of the Prior Art

There have long been sliding door security devices which block the doors from sliding open. These devices, however, are generally not designed to prevent the doors from being pushed out of their track.

One such anti-sliding device is disclosed in Blough, U.S. Pat. No. 4,379,576, issued on Apr. 12, 1983. Blough teaches a fixed bracket which bolts to one door and presents a horizontal lip with a hole in it. A pivoting bracket is attached to an end of the adjacent door which rotates down to present a horizontal surface resting on top of the lip. A hole is provided in this surface directly over the hole in the lip, so that a bolt or padlock can be inserted through them. In addition to preventing sliding, the bolt or padlock incidently prevents one door from being lifted away from the adjacent door at the point they are joined. This structure, however, does not prevent the doors from being lifted together out of their track or pivoted relative to each other. Also, Blough requires the inconvenience of removing and reinserting the bolt or lock each time the doors are opened.

Another anti-sliding device is illustrated in Stevens, U.S. Pat. No. 4,248,461, issued on Feb. 3, 1981. Stevens discloses a long, spring-loaded plate having a series of ratchet-shaped vertical catches. A tab projects from the door adjacent to the plate and engages the catches. Pressing down on an end of the plate releases the tab so that the adjacent door can slide to a new position. Then the plate is released and the nearest catch engages the tab and secures the door against further sliding. Stevens thus permits the door to be secured in a variety of positions. A problem with Stevens, as noted above, is that it does not prevent the doors from being lifted off their track and pushed open. Although the ratchet apparatus by chance blocks one side of one door, the door can still be pushed out in the other direction.

An anti-sliding device for a screen door is described in Kelly, U.S. Pat. No. 4,284,299, issued on Aug. 18, 1981. Kelly discloses a handle which bolts onto a vertical edge of a screen door, having a spring-loaded lip which snaps into the door frame. The vertical section of the door frame is a channel which might prevent lateral movement of the door when closed within it. Yet this frame only secures an end of the door at best, and does not prevent it from being lifted off and pivoted out of its track.

Guardia, U.S. Pat. No. 4,763,933, issued on Aug. 16, 1988, discloses an anti-sliding mechanism for a sliding door which telescopes with a fixed door. Guardia has a rotary knob-operated bolt on an end of one door which engages a slot on the other door to keep the doors from sliding relative to each other. In addition to the rotary bolt feature, Guardia provides a latch feature which also prevents relative sliding. The latch projects from the knob assembly into a catch on the other door. The knob assembly pivots away from the catch to release the latch. Although Guardia prevents one door from sliding relative to the other, it does not prevent them from being lifted up and out of their track.

An anti-sliding mechanism providing multiple bolts is taught in Logas, U.S. Pat. No. 4,643,005, issued on Feb. 17, 1987. A key mechanism simultaneously operates two hook bolts and two straight bolts, joined together by linkages. Holes are provided for the straight bolts to permit them to lock the door in the closed position, or in a partly open position. A problem with Logas is that it only secures the door at one end, so that it could conceivably still be lifted and pivoted out of its track.

A security device to prevent sliding doors from being lifted out of their track is taught in Gist, U.S. Pat. No. 4,526,412, issued on July 2, 1985. Gist teaches a clip which snaps onto the track. The clip is a channel which fits over an edge of the track, having an inwardly curved wall to grip the track. The other wall of the channel is bent outward at a right angle and extends over the top of the door, blocking upward movement. A problem with Gist is that the clip could fall out of the track while the door is open. Gist also provides no retaining means to block a door from being pushed or kicked out of its track, apart from the happenstance structure of the track itself.

Several design patents which pertain to window frames are also found in the prior art. These include Dallaire, U.S. Design Pat. No. 216,955, entitled Extruding Sliding Window Member, issued on Mar. 24, 1970; Dallaire, U.S. Design Pat. No. 226,374, entitled Extruded Plastic Header Track for a Window Unit, issued on February 1973; Dallaire, U.S. Design Pat. No. 250,352, entitled Window Component Extrusion, issued on Nov. 21, 1978; and Mauro, U.S. Design Pat. No. 250,843, issued on Jan. 16, 1979. None of these design patents appears to teach a mechanism to lock a sliding door or window against being lifted or pushed out of its track.

It is thus an object of the present invention to provide a device which locks sliding panels against being lifted or pushed out of their track, as may result from an attempted burglary or a high wind.

It is another object of the present invention to provide such a device which secures the doors along a greater extent than a single point.

It is finally an object of the present invention to provide such a device which is inexpensive, easy to install and reliable.

SUMMARY OF THE INVENTION

The present invention accomplishes the above-stated objectives, as well as others, as may be determined by a fair reading and interpretation of the entire specification.

An apparatus for securing telescoping sliding panels, which are essentially oriented in parallel, vertical planes, against movement perpendicular to their sliding directions, where each panel has a lower edge, is provided, including at least one track, parallel first and second carriages which retain the lower edge of each panel and ride along the at least one track, at least one lip projecting from at least one first carriage having an upturned free end, at least one lip projecting from at least one second carriage having a downturned free end which extends between the at least one first carriage and the upturned end of its at least one lip. The carriage for each panel preferably includes a body portion which is tubular and has wheels mounted beneath it and gripping members projecting from the top of it for holding a channel which receives the lower edge of the panel. The channel is preferably made of vinyl. The at least one track has an upper surface with at least one channel recessed into the upper surface for guiding the carriages. The at least one track has two longitudinal edges, one of which is angled downward to form a molding portion and the other is turned upward at an essentially right angle to form a wall portion for retaining the carriages. The wall portion is preferably provided with at least one lip as described above. A threshold member is optionally provided which attaches to the wall portion and a channel of the at least one track, to provide a horizontal surface which a person can step on without damaging the threshold member. The threshold member may have at least one lip as described above. Also optionally provided is an anchor member for at least one of the panels, including an essentially U-shaped channel, secured under the body portion, having at least one lip projecting from it into a recess in the at least one track to secure the panel and its carriages against movement perpendicular to the axis of the track. Buffer members are preferably provided for separating surfaces with relatively soft, low friction material such as vinyl. The buffer member preferably takes the form of at least one strip of material having an axially directed T-shaped ridge which slides into at least one channel in the at least one track.

A method is provided for retaining sliding telescoping panels riding on first and second carriages, the first carriage having at least one first lip with an upturned edge and the second carriage having at least one second lip with a downturned edge, within channels along at least one track against movement relative to each other perpendicular to their geometric planes, including the step of placing the downward portion of the at least one second lip between the upward portion of the least one first lip and the first carriage.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
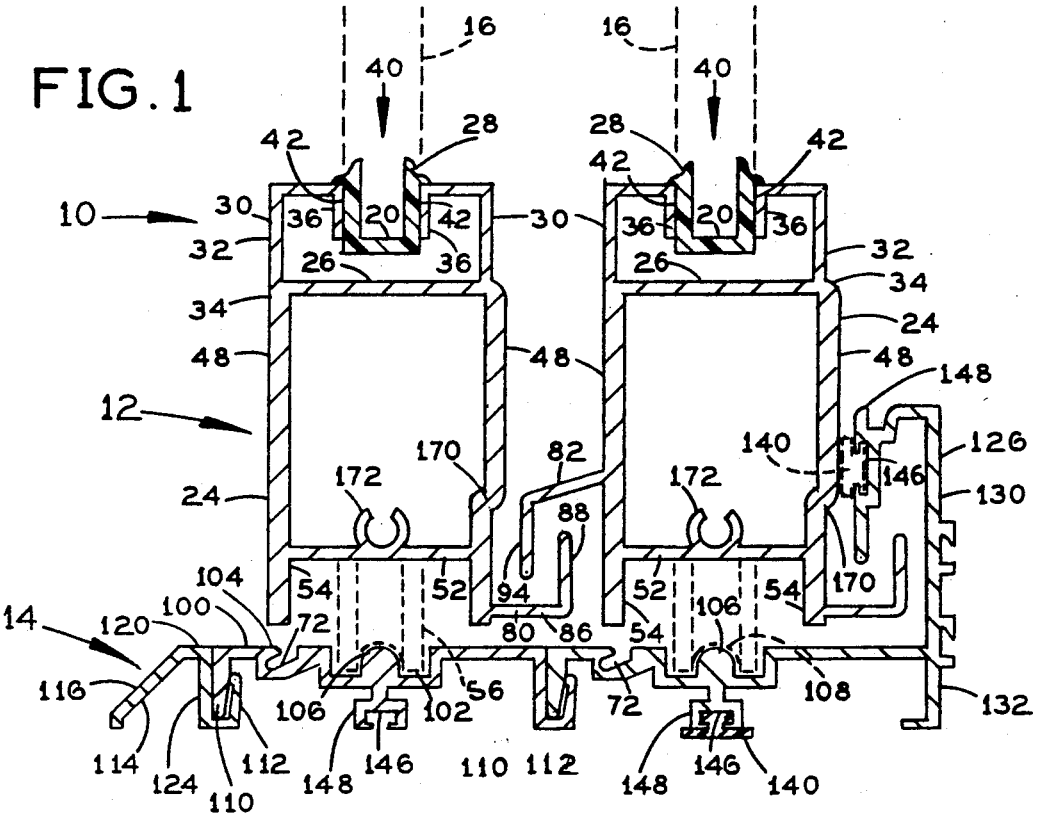
FIG. 1 is a cross-sectional end view of the first preferred embodiment of the inventive apparatus, illustrating the track wall portion having the interlocking lip feature, with a buffer channel in the lip. Wheels are shown in broken lines. All panels are mounted on wheels and are free to slide.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Referring to FIG. 1, a sliding panel mount 10 for telescoping doors and windows is disclosed which includes a panel carriage 12 and a carriage track 14. The panel 16 may be formed of glass, wood, screen, or other material, and has an essentially horizontal lower edge 20. Mount 10 is provided along lower edge 20 and permits panel 16 to slide horizontally within its geometric plane while retaining panel 16 against being lifted or laterally pushed out of track 14. Mount 10 thereby prevents dislodgment by burglars or the wind, and accidental dislodgment as during cleaning.

Carriage 12 and track 14 are each of essentially constant cross-section, and are preferably aluminum extrusions. Carriage 12 has a tubular portion 24 which is essentially rectangular in cross section. See FIG. 1. Various lips and ridges project from tubular portion 24 to give carriage 12 its functional characteristics.

Lower edge 20 of panel 16 is mounted in a U-shaped channel 28, preferably made of vinyl. Projecting upward from the top face 26 of tubular portion 24 are retaining lips 30 for holding channel 28. Again viewed in cross-section, retaining lips 30 preferably have an inverted U-shape. What will be referred to as the first leg 32 of each retaining lip 30 is attached near an edge 34 of top face 26, and the rest of each retaining lip 30 extends toward the middle of top face 26. The second leg 36 of each retaining lip 30 extends toward but stops short of contact with top face 26, permitting retaining lip 30 to resiliently pivot on first leg 32. Retaining lips 30 are of sufficiently narrow width that a gap 40 exists between them which receives channel 28. Channel 28 fits snugly between and is resiliently gripped by retaining lips 30. The face 42 of each second leg 36 which makes contact with channel 28 is preferably grooved or otherwise abraded to increase the friction between channel 28 and lips 30.

Figure 2:
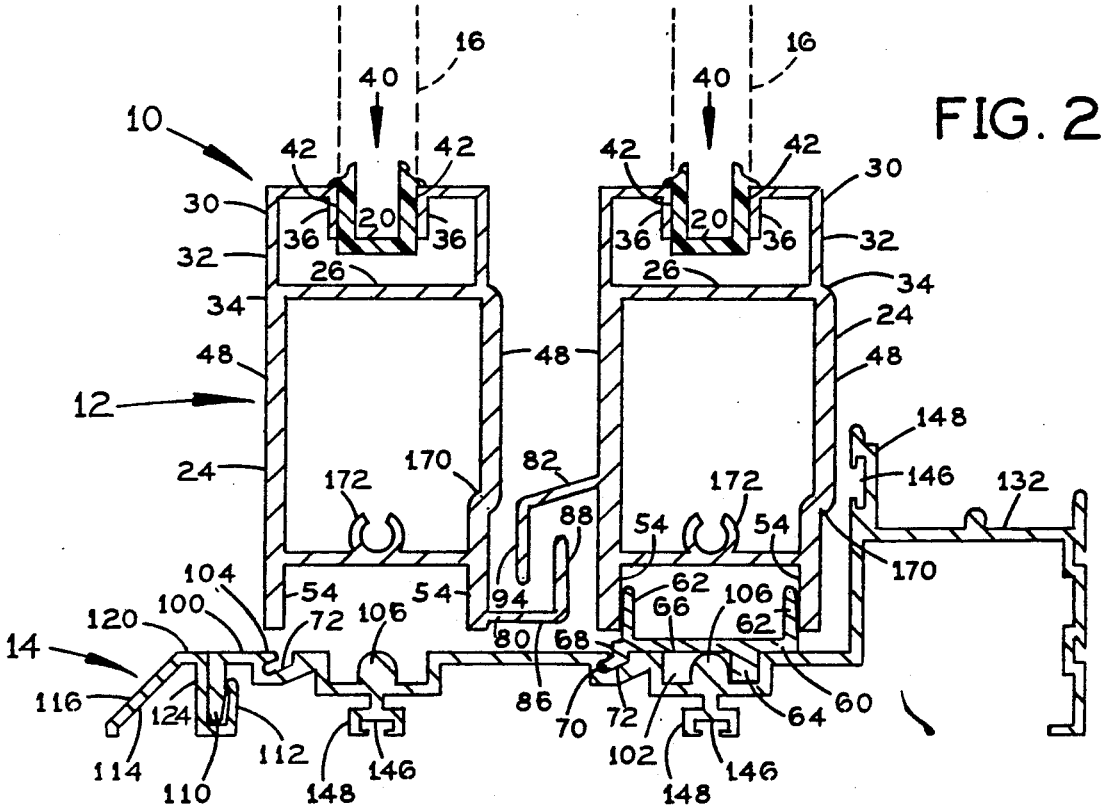
FIG. 2 is another cross-sectional end view of the inventive apparatus, illustrating the double channel plate design. One channel is fitted with the anchor member feature, preventing its panel from sliding. The other panel is mounted on wheels and is free to slide. Wheels not shown to leave room for part numbers.

Side faces 48 of carriage 12 extend vertically below the bottom face 52 of tubular portion 24 to form guide walls 54. Carriage 12 rides on a plurality of wheels 56 mounted in wheel assemblies. The wheel assemblies are retained between guide walls 54. Alternatively, an anchoring member 60 is provided which is essentially U-shaped and its legs 62 fit snugly between guide walls 54. See FIG. 2. An anchor lip 64 projects vertically downward from the lower face 66 of member 60 and lodges in track 14. In addition, a foot ridge 70 projects downward and outward from an edge 68 of lower face 66 into a correspondingly angled groove 72 in track 14. Anchor lip 64 and foot ridge 70 secure anchoring member 60, and thus carriage 12 and panel 16, against movement perpendicular to the geometric plane of panel 16.

Panels 16 open by telescoping one in front of the other. To prevent a wheeled panel 16 from being pushed out of track 14 and away from its adjacent panels 16, interlocking lips 80 and 82 are provided along carriages 12. Lip 80 extends from the side face 48 of a guide wall 54 toward an adjacent carriage 12 to form a level portion 86, and then turns upward at a right angle to form an upward portion 88. Lip 82 extends from a side face 48 over lip 80 of adjacent carriage 12 to form a level portion 90, and then vertically downward between side face 48 of adjacent carriage 12 and upward portion 88 to form a downward portion 94. Thus, should a force be applied to separate panels 16, the upward portion 88 of lip 80 locks against the downward portion 94 of lip 82, blocking separation.

Track 14 guides and retains panels 16, and comprises a horizontal plate 100 having parallel wheel channels 102 recessed into its upper surface 104. Plate 100 is preferably formed of parallel segments, each having a single channel 102, joined together. See FIG. 1. Wheels 56 ride in channels 102. One channel 102 is provided for each panel 16, and each channel 102 extends the length of track 14. Channels 102 are preferably square U-shaped recesses having an upward projecting semicircular ridge 106 extending axially along its center. Wheel 56 preferably has a semicircular recess 108 around the middle of its circumferential surface corresponding in dimensions with semicircular ridge 104. The relative widths of wheel 56 and channel 102 are such that wheel 56 fits within channel 102 with sufficient clearance on either side to roll freely. Semicircular ridge 106 retains wheel 56 against lateral movement within channel 102. Adjacent and parallel to each channel 102 in upper surface 104 is angled groove 72 for receiving foot ridge 70, as described above. Anchor lip 64 fits within channel 102 to one side of semicircular ridge 104.

The edge 110 of track 14 directed toward the interior of the building is preferably bent downward at a right angle to form a mounting lip 112. A molding member 114 interlocks with lip 112 to provide a finished, beveled edge. Molding member 114 is another constant cross-section element, also preferably formed of extruded aluminum. Molding member 114 comprises a ramp portion 116, which levels into a horizontal top surface 120. Top surface 120 turns vertically downward, then extends horizontally away from ramp portion 116 and finally upward to form a receiving groove 124. Lip 102 of track 14 fits down into receiving groove 124 to secure molding member 114 relative to track 14. Adjacent edges of the parallel segments forming plate 100 are also formed into a lip 112 and receiving groove 124 so that the segments can interlock.

The edge 126 of track 14 opposite edge 110 turns vertically upward beside the nearest carriage 12 to form a wall 130 for retaining carriage 12. An anchor member 132 optionally extends from retaining wall 130 away from carriages 12 to join track 14 with the masonry of the building.

Buffer strips 140 preferably serve as buffers between track 14 and the surface on which track 14 rests. They are optionally provided between retaining wall 130 and the adjacent carriage 12. Strips 140 have T-shaped ridges 146 which snap into C-shaped gripping channels 148 on track 14 and in wall 130.

Figure 3:
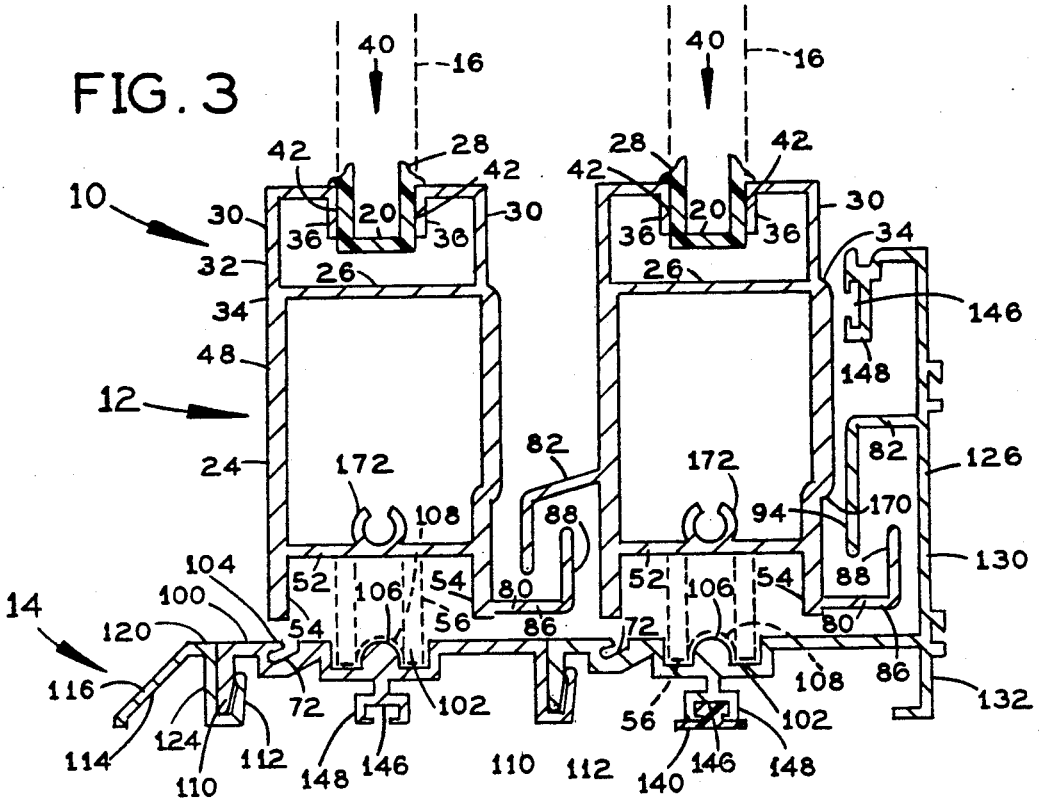
FIG. 3 is a cross-sectional end view of the inventive apparatus, similar to FIG. 1 and having a taller wall, illustrating the interlocking lip, with the buffer channel located on a projection separate from the lip.

All panels 16 are preferably provided with wheels 56 and slide freely. In this instance, retaining wall 130 is provided with a lip 82 to interlock with a lip 80 on its adjacent carriage 12. See FIG. 1. A gripping channel 148 may be provided on lip 82 of wall 130, as shown in FIG. 1, or separately, as shown in FIG. 3. Alternatively, at least one of panels 16 may be fitted with an anchoring member 60 while the other panels 16 ride on wheels 56. An anchoring member 60 can take the place of or supplement the retaining function of lip 82 on wall 130. See FIG. 2.

Figure 4:
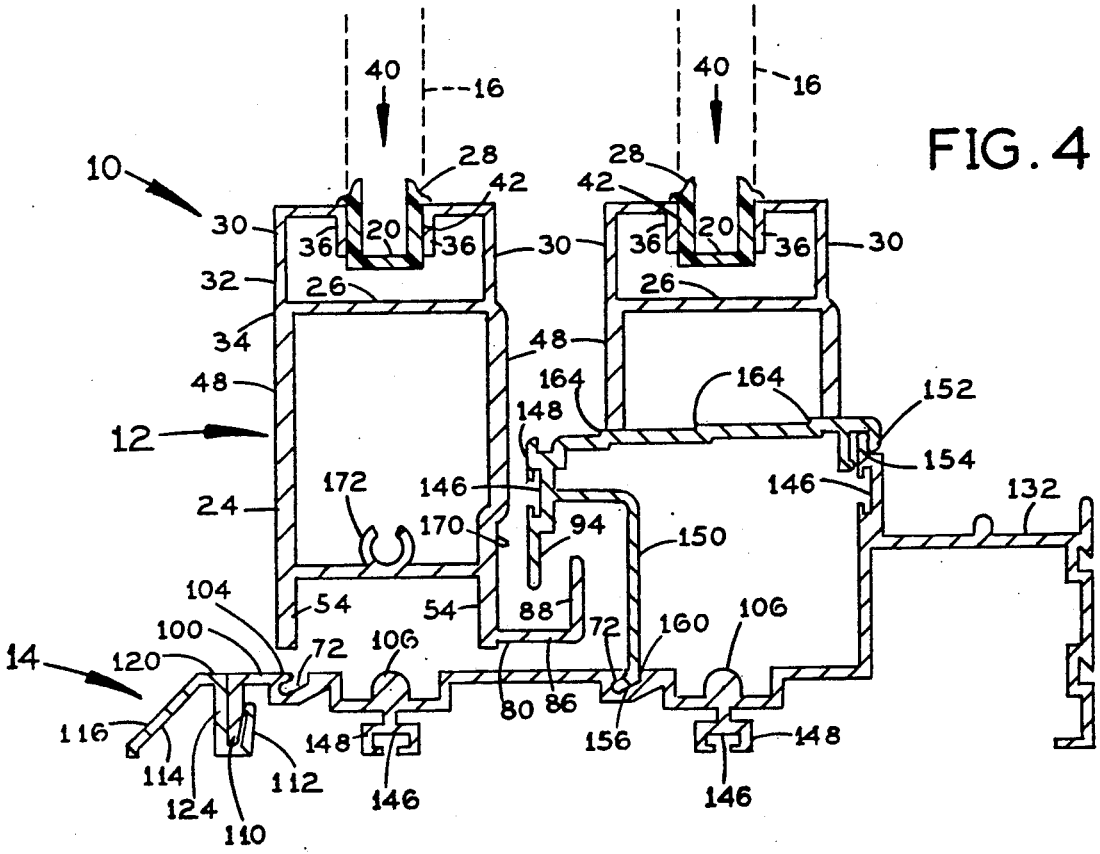
FIG. 4 is a cross-sectional end view of the inventive apparatus, having the double channel plate design as in FIG. 2, and fitted with the locking threshold member feature.
Figure 5:
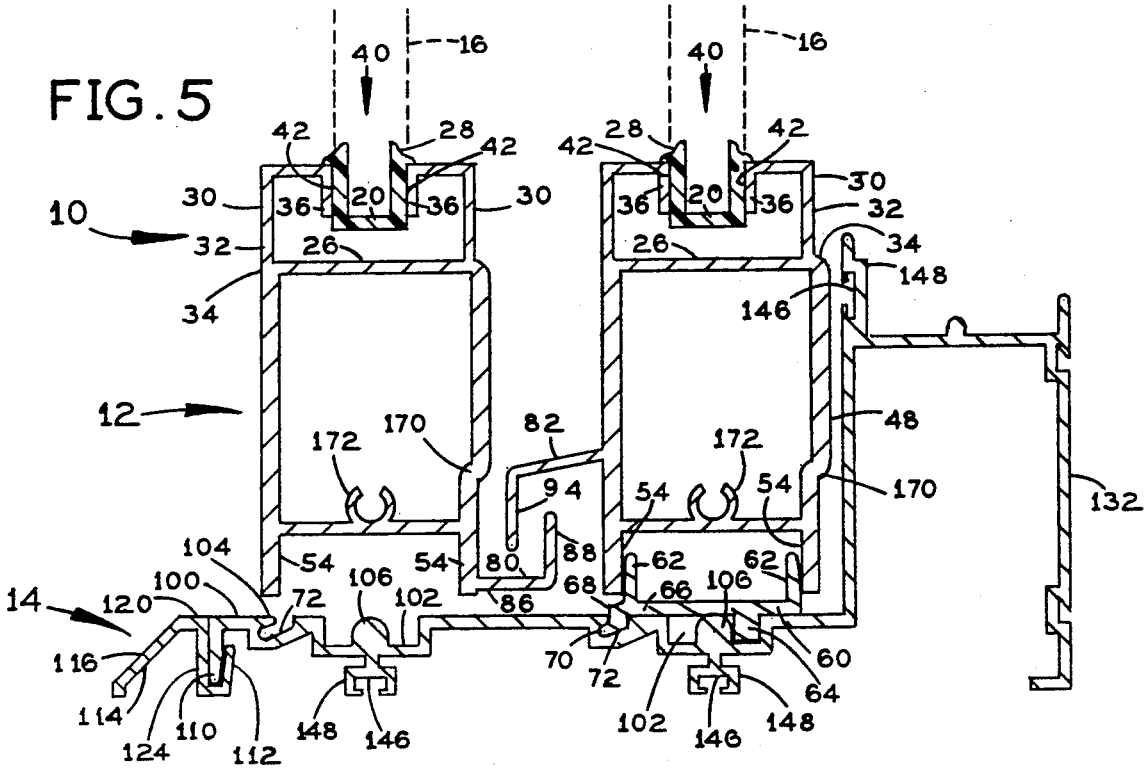
FIG. 5 is a cross-sectional end view of the inventive apparatus having the double channel plate design as in FIG. 2 and having a high wall portion.
Figure 6:
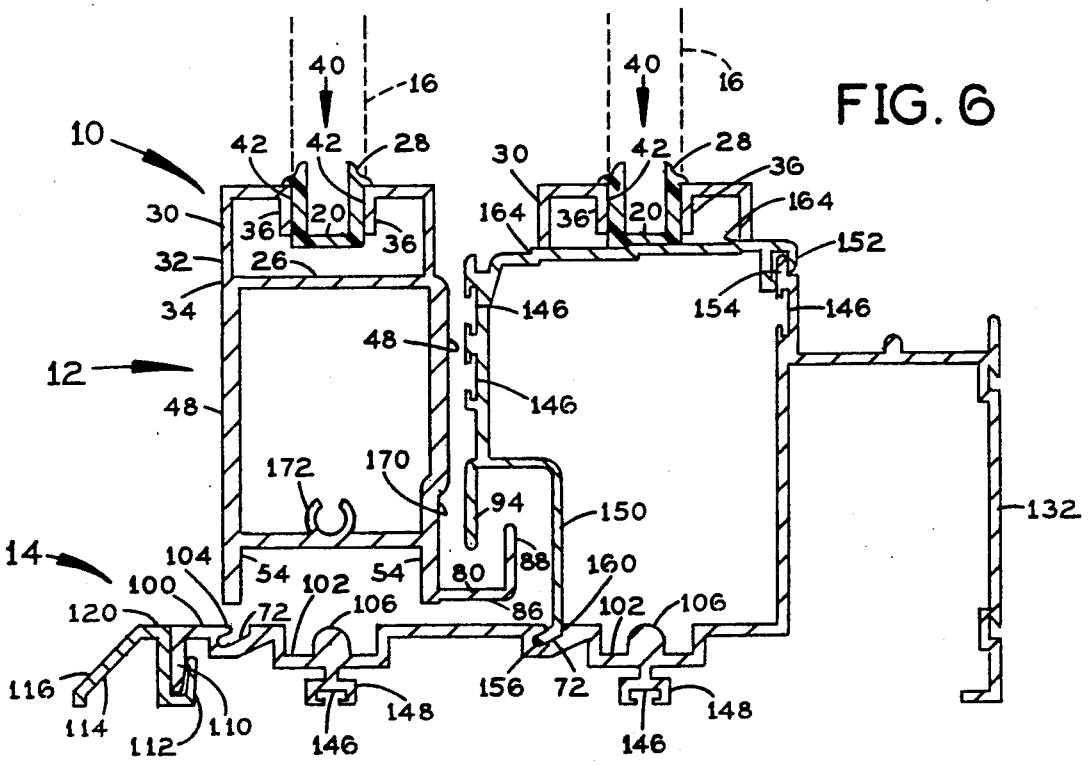
FIG. 6 is a cross-sectional end view of the inventive apparatus having the double channel plate design, as in FIG. 5, and having a high wall portion fitted with a correspondingly high threshold member feature.
Figure 7:
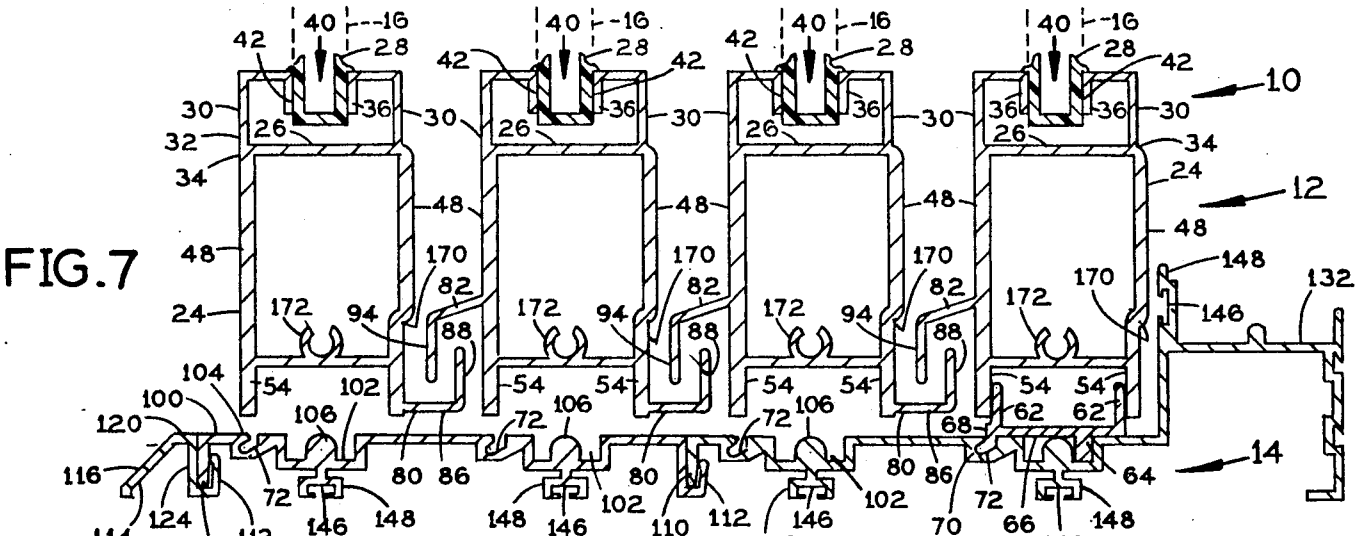
FIG. 7 is a cross-sectional end view of a four panel version of the inventive apparatus, having the low wall portion and the double channel plate, similar to FIG. 2 but with two such plates. The anchor member feature is provided and secures one plate, while all others are free to slide.
Figure 8:
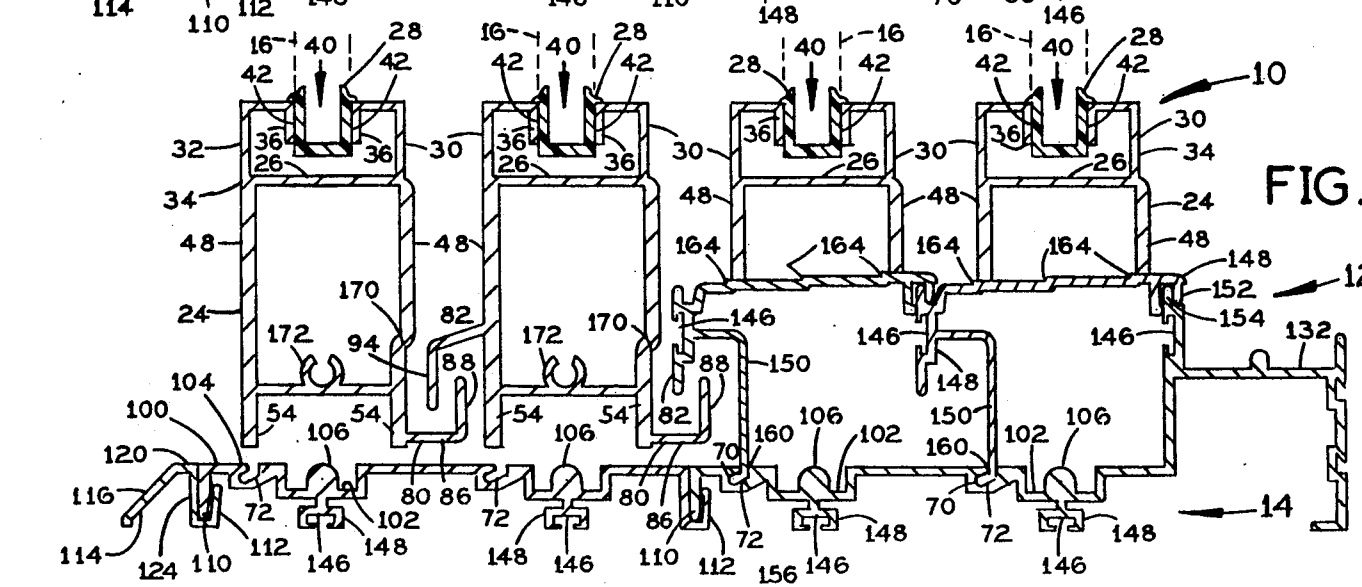
FIG. 8 is a cross-sectional end view of a four panel version of the inventive apparatus, as in FIG. 7, fitted with two laterally adjacent threshold members.
Figure 9:
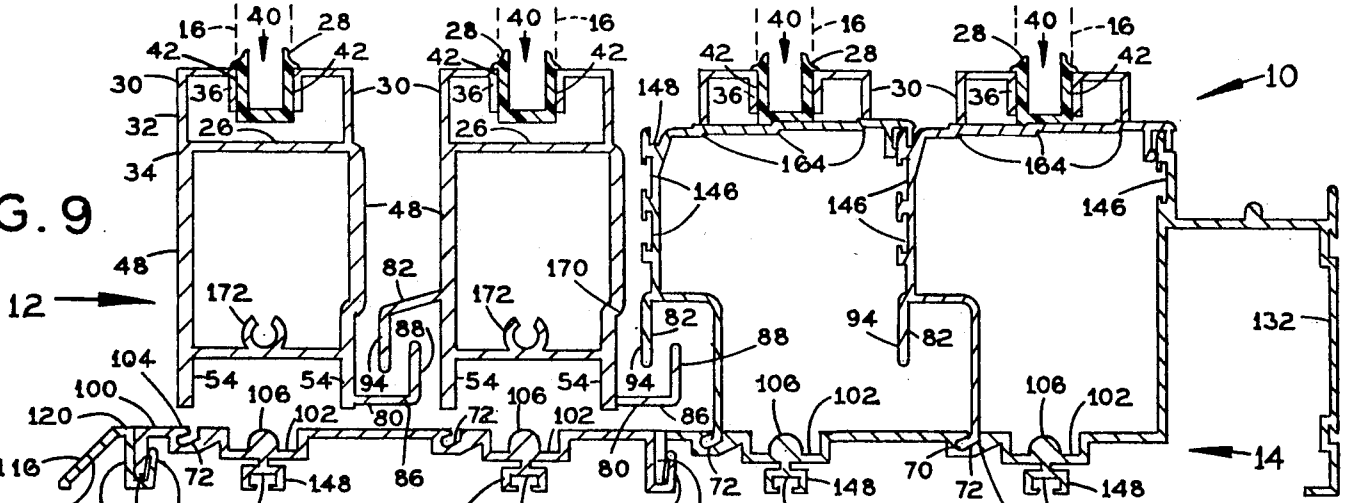
FIG. 9 is a cross-sectional end view of a four panel version of the inventive apparatus with the high wall portion, fitted with two laterally adjacent threshold members.
Figure 10:
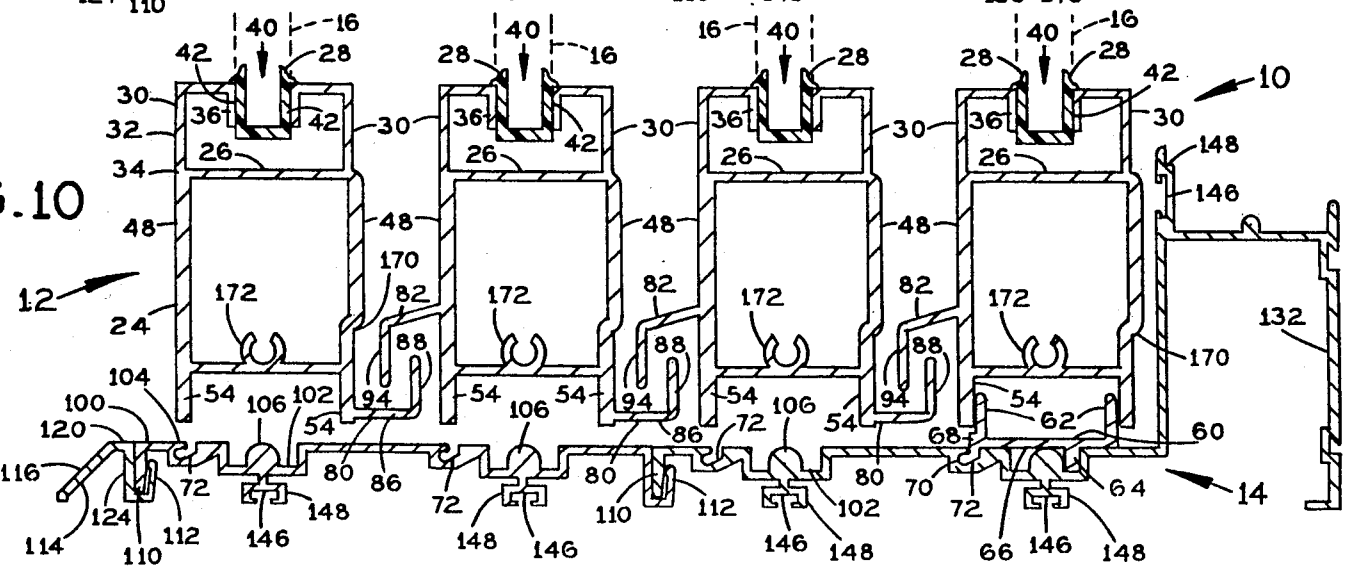
FIG. 10 is a cross-sectional end view of a four panel version of the inventive apparatus, as in FIG. 9, with the high wall portion, fitted with an anchor member to fix one panel.

A threshold member 150 is optionally provided which has an essentially inverted L-shape. See FIG. 4. The purpose of threshold member 150 is retain the stationary carriage 12 against movement along track 14 and to provide a flat, smooth upper surface on which one can step. Threshold member 150 has a channel portion 152 which fits over the upper edge 154 of retaining wall 130. The tip 156 of the other edge 160 of threshold member 150 is bent to form foot ridge 70 and fits into angled groove 72. A lip 82 may be provided on threshold member 150 to engage and retain the carriage 12 sliding adjacent to it, as illustrated in FIG. 4. A gripping channel 148 may be provided in lip 82 to secure a weather strip 140 between threshold member 150 and the adjacent carriage 12. Since threshold member 150 may be stepped on in normal use, slight jogs or corrugations 164 may be provided to make it resistant to denting. To extend tubular portion 24, ridges 170 may be provided, as shown in all figures. Ridges 170 extend to provide a surface flush with vertical edges of panel 16, not shown in the figures, for making contact with vertical weather strips. The most compact location for them is inside tubular portion 24. A jog 172 forms a screw receiving spline for panel 16 assembly.

Alternative Embodiments

Several variations of track 14 are contemplated and include the following. Various wall 130 heights may be provided, as shown comparatively between FIGS. 2 and 5, as well as FIGS. 4 and 6. This option permits the construction of a track 14 having any desire number of channels 102 to accommodate any desired number of panels 16. FIGS. 7, 8, 9, and 10 illustrate tracks for four panels 16. A single plate 100 may have two parallel wheel channels 102 impressed into it, as shown in FIGS. 2, 4, 5, 6, 7, 8, 9 and 10. Plates 100 having more than two wheel channels 102, although not illustrated in the various figures, are contemplated.

Method

In practicing the invention, the following method may be used. To retain sliding panels 16 riding on carriages 12 having lips 80 and 82, along tracks 14 against movement out of their channels 102, one places downward portion 94 of lip 82 between upward portion 88 of lip 80 and side face 48 of adjacent carriage 12.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for securing telescoping sliding panels, which are essentially oriented in parallel, vertical planes, against movement perpendicular to their sliding directions, wherein each panel has a lower edge, comprising:

track means, parallel first and second carriage means which retain the lower edge of each panel and ride along the track means, lip means projecting from at least one first carriage means having an upturned free end, lip means projecting from at least one second carriage means having a downturned free end which extends between the at least one first carriage means and the upturned end of its lip means.

2. An apparatus as in claim 1, wherein the carriage means for each panel comprises a body portion which is tubular and has wheel means mounted beneath it and gripping members projecting from the top of it for holding channel means which receives the lower edge of the panel.

3. An apparatus as in claim 2, wherein the channel means are made of vinyl.

4. An apparatus as in claim 1, wherein the track means have an upper surface with at least one channel recessed into said upper surface for guiding the carriage means.

5. An apparatus as in claim 4, wherein the track means has two longitudinal edges, at least one of which is angled downward to form a molding portion.

6. An apparatus as in claim 4, wherein the track means has two longitudinal edges, at least one of which is turned upward at an essentially right angle to form a wall portion for retaining the carriage means.

7. An apparatus as in claim 6, wherein the wall portion is provided with lip means as described in claim 1.

8. An apparatus as in claim 6, additionally comprising a threshold member which attaches to the wall portion and a channel of the track to provide a horizontal surface which a person can step on without damaging the threshold member.

9. An apparatus as in claim 8, wherein the threshold member has lip means as described in claim 1.

10. An apparatus as in claim 2, additionally comprising an anchor member for at least one of the panels, comprising an essentially U-shaped channel secured under the body portion having at least one lip projecting from it into a recess in the track means to secure the panel and its carriage means against movement perpendicular to the axis of the track means.

11. An apparatus as in claim 1, additionally comprising buffer means for separating surfaces with relatively soft, low friction material.

12. An apparatus as in claim 11, wherein the buffer means comprise at least one strip of buffer material extending parallel to the track means which is attached to the track means.

13. An apparatus as in claim 12, wherein the at least one strip has an axially directed T-shaped ridge which slides into at least one channel in the track means.

14. An apparatus as in claim 1, wherein the track means is formed of parallel track members joined together.

15. A method of retaining sliding telescoping panels riding on first and second carriage means, the first carriage means having at least one first lip with an upturned edge and the second carriage means having at least one second lip with a downturned edge, within channels along track means against movement relative to each other perpendicular to their geometric planes, comprising the step of:

placing the downward portion of the at least one second lip between the upward portion of the least one first lip and the first carriage means.

* * * * *